United States Patent [19]

Galow et al.

[11] 4,286,912

[45] Sep. 1, 1981

[54] PROCESS AND APPARATUS FOR CHARGING AND SEALING A CHARGING PORT OF A CHAMBER

[75] Inventors: Manfred Galow; Wilhelm Busbach, both of Essen, Fed. Rep. of Germany

[73] Assignee: Didier Engineering GmbH, Essen, Fed. Rep. of Germany

[21] Appl. No.: 24,041

[22] Filed: Mar. 26, 1979

[30] Foreign Application Priority Data

Apr. 12, 1978 [DE] Fed. Rep. of Germany ..... 2815739

[51] Int. Cl.[3] ..... C10B 31/02

[52] U.S. Cl. ..... 414/287; 414/201; 414/292; 414/786

[58] Field of Search ..... 414/167–170, 414/199–206, 786, 287, 292; 432/242, 250; 266/176, 184; 202/250, 251, 262, 263

[56] References Cited

U.S. PATENT DOCUMENTS

| | | | |
|---|---|---|---|
| 2,599,334 | 6/1952 | Latham | 414/202 |
| 2,721,073 | 10/1955 | Gionet | 266/184 |
| 3,732,993 | 5/1973 | Csapo | 414/206 X |
| 4,009,081 | 2/1977 | Ueda | 414/201 X |
| 4,033,730 | 7/1977 | Baron et al. | 202/251 X |

*Primary Examiner*—Robert G. Sheridan

*Attorney, Agent, or Firm*—Wenderoth, Lind & Ponack

[57] ABSTRACT

A drivable member has an opening therethrough and is positioned within a charging port of a chamber. The drivable member has suspended therefrom an inner cover. The drivable member is axially movable with respect to the charging port between a raised position, whereat the inner cover is moved into a sealing position against an inner surface of the charging port, and a lowered position, whereat the inner cover is moved away from the inner surface. An intermediate seal is formed between the exterior of the charging port and an exterior portion of the drivable member, and the intermediate seal is maintained during all positions of movement of the drivable member. An outer cover is selectively movable into sealing engagement with an upper portion of the drivable member to form an outer seal. The outer cover may be removed and replaced by a material supply container which also forms an outer seal with the upper portion of the drivable member. Thereafter, the drivable member may be moved to the lowered position thereof to open the inner seal, and material be charged from the container through the opening and the charging port into the interior of the chamber.

24 Claims, 4 Drawing Figures

FIG. 3
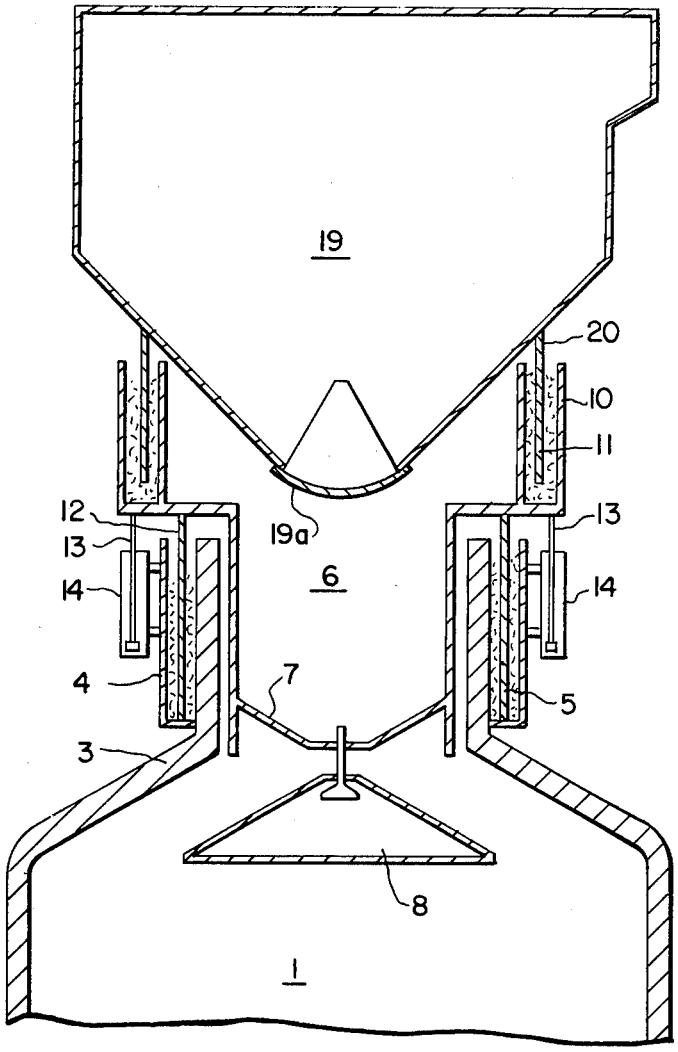
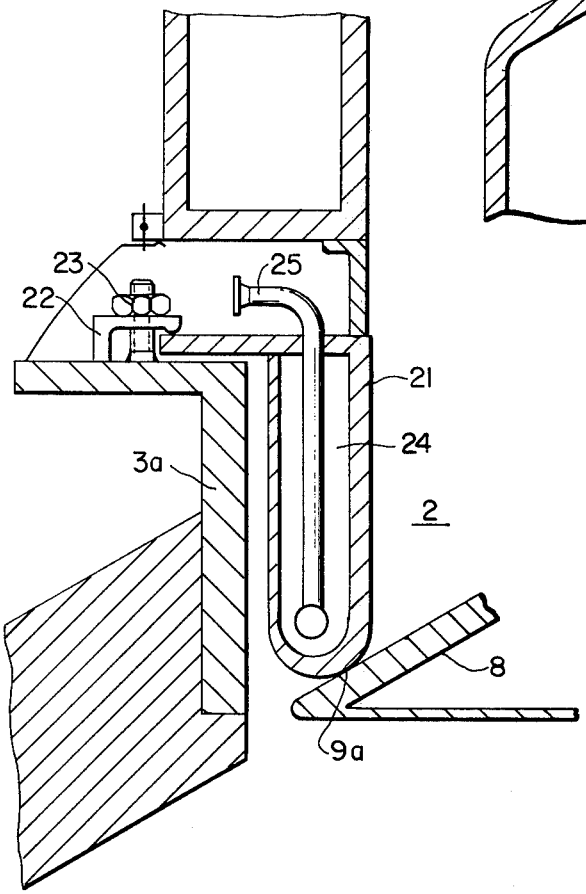
FIG. 4

PROCESS AND APPARATUS FOR CHARGING AND SEALING A CHARGING PORT OF A CHAMBER

BACKGROUND OF THE INVENTION

The present invention relates to a process and an apparatus for charging and sealing a charging port of a chamber, particularly of a cooling chamber for a dry coke cooling operation.

In presently known arrangements, a simple closing cover is positioned over the charging port of a cooling chamber during operation of the chamber. Such closing cover must be removed from the charging port when a new charge of material, for example coke, is to be introduced into the chamber. After the chamber has been charged, the closing cover is again positioned to close and seal the charging port.

However, this known arrangement presents several inherent disadvantages.

Particularly, during removal of the closing cover, the interior of the chamber is then open to the surrounding environment. In the event that there is any excess pressure in the chamber, dust and gas are readily discharged into the surrounding environment. Such phenomenon is disadvantageous for obvious safety and pollution reasons.

Furthermore, during normal operation of the chamber, for example of a dry coke cooling chamber, it is difficult to ensure sufficient sealing of the known closing cover with the charging port of the chamber. This results in the frequent discharge of gas from the chamber to the surrounding environment, even when the closing cover is in a closed position.

SUMMARY OF THE INVENTION

With the above discussion in mind, it is the primary obect of the present invention to provide a process and an apparatus whereby it is possible to ensure the tight sealing of the interior of the chamber from the surrounding environment both during charging of the chamber and during the normal operation thereof.

This object is achieved in accordance with the present invention by the provision of a drivable member adapted to be movably mounted adjacent a chamber charging port. An outer cover is movable between a closed position in sealing engagement with the drivable member and an open position away from the drivable member. An inner cover is supported by the drivable member and is movable thereby between a sealing position whereat the inner cover is adapted to seal against a surface of the chamber charging port which faces generally away from the outer cover and an open position spaced from such surface. Preferably, the drivable member includes a lower portion adapted to be inserted into the chamber charging port and an upper portion adapted to be positioned outwardly of the chamber charging port. The drivable member has extending therethrough an opening adapted to communicate with the interior of the chamber. Further preferably, a support member extends transversely across the opening in the lower portion of the drivable member, and the inner cover is rockably or flexibly suspended from the support member at a position below the lower portion of the drivable member.

The upper portion of the drivable member includes a channel surrounding the opening through the drivable member. The channel has a closed bottom and an open top, and a yieldable sealing medium is housed within the channel. The outer cover has depending therefrom a substantially annular projection dimensioned to extend into the yieldable sealing medium within the channel when the outer cover is in the closed position thereof. The outer cover may be lifted away from the drivable member and replaced by a material supply container, for example a coke container, movable into alignment with the opening and the charging port to supply material, for example coke, into the chamber. The container has depending therefrom a substantially annular projection dimensioned to extend into the yieldable sealing medium within the channel and to thereby form a seal between the container and the drivable member.

In accordance with a further feature of the present invention, an intermediate seal is maintained between the exterior of the chamber charging port and the drivable member, in all positions of axial movement of the drivable member. The intermediate seal includes a channel surrounding and fixed to the chamber charging port. The channel has a closed bottom and an open top and is filled with a yieldable sealing medium. The upper portion of the drivable member has depending therefrom a substantially annular projection dimensioned to extend into the yieldable sealing medium within the channel which is fixed to the exterior of the chamber charging port.

Driving devices, for example piston-cylinder arrangements, are fixed to the exterior of the channel which is fixed to the exterior of the chamber charging port, and are also fixed to the upper portion of the drivable member. Operation of such driving devices selectively axially moves the drivable member with respect to the charging port between the raised and lowered positions of the drivable member. The annular projection which extends from the drivable member is dimensioned to extend into the yieldable sealing medium within the channel fixed to the exterior of the charging port by a distance sufficient to form the intermediate seal in both the raised and lowered positions of the drivable member. Thus, the intermediate seal is maintained at all times. When the drivable member is moved to the raised position thereof, the driving devices may be operable to lock the drivable member in such raised position.

When it is desired to charge a new supply of material, for example coke, into the chamber, the drivable member is maintained in the raised position thereof. The outer cover is removed from the drivable member and is replaced by a material supply container in a manner to form an outer seal between the container and the drivable member. The driving devices then move the drivable member to the lowered position thereof, thereby opening the inner seal between the inner cover and the charging port, whereby material, for example coke, may be supplied through the opening and charging port into the chamber. When the chamber is thus charged, the driving devices are then operated to return the drivable member to the raised position thereof, thereby returning the inner cover to the sealed position thereof and closing the inner seal. The container is then removed from the drivable member and is again replaced by the outer cover in such a manner as to form an outer seal between the outer cover and the drivable member.

Thereafter, whenever it is desired to supply a new charge into the chamber, the above sequence of operations is repeated. It will be understood that the intermediate seal is maintained at all times, and at least one of the inner seal and the outer seal is maintained at all times. Accordingly, both during charging and during normal operation of the chamber at least two seals are always maintained.

In accordance with a further feature of the present invention, a replaceable annular insert may be positioned within the charging port of the chamber. A lower surface of such insert comprises the surface against which the inner cover seals to form the inner seal. The transverse dimension of the inner cover is less than that of the charging port. By this arrangement, the annular insert may be readily removed from the charging port, thereby allowing easy removal and insertion of the inner cover through the charging port. Furthermore, the replaceable insert may have a hollow interior, and means may be provided for introducing a cooling medium through the hollow interior of the insert, thereby providing for cooling of the insert.

BRIEF DESCRIPTION OF THE DRAWINGS

Other objects, features and advantages of the present invention will be apparent from the following detailed description, taken with the accompanying drawings, wherein:

FIG. 3 is a schematic view similar to FIGS. 1 and 2, but showing the inner cover in the unsealed position thereof, and showing a material supply container being positioned to form an outer seal, for charging of the chamber; and FIG. 4 is an enlarged schematic cross-sectional view of a modification of a portion of FIG 1.

DETAILED DESCRIPTION OF THE INVENTION

The drawings illustrate, and the following description will be made of a process and an apparatus for charging and sealing a charging port of a cooling chamber for a dry coke cooling operation. However, it is to be understood that such is a preferred and particularly advantageous application of the present invention only and is not intended to be limiting of the scope of the present invention.

Figure 1:
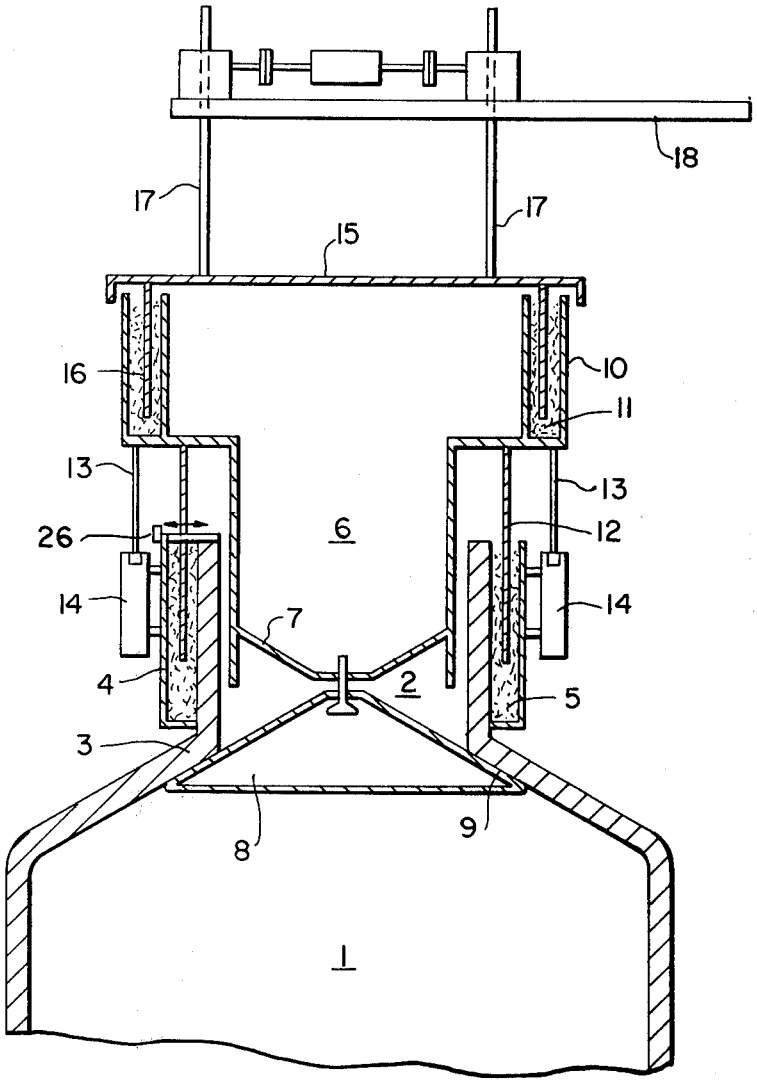
FIG. 1 is a schematic cross-sectional view of one embodiment of the present invention, wherein the inner and outer covers are shown in the sealed positions thereof during normal operation of a chamber.

With reference now to FIG. 1 of the drawings, there is shown therein an antechamber or precombustion chamber 1 of a plant for a dry coke cooling operation. Chamber 1 has therein a charging port 2 formed by an upwardly extending annular neck 3 surrounding charging port 2. It will be understood that a convenient configuration for elements extending into or parallel to charging port 2 is a cylindrical configuration. However, it is not intended that the present invention be limited to such cylindrical configuration, as other configurations which would be apparent to those skilled in the art may be employed in the present invention. Thus, as employed herein, the term "annular" is not intended to be limited solely to a circular or cylindrical configuration, but rather is intended to refer to any closed configuration which would be obvious to those skilled in the art and which for example might be necessitated by the configuration of charging port 2 and neck 3.

In accordance with the present invention, there is provided a drivable member 6 having a lower portion extending into the neck of the charging port 2 and an upper portion. The drivable member 6 has an opening therethrough adapted to be in communication with the interior of chamber 1. The lower portion of drivable member 6 has fixed thereto at a position to extend across the opening therethrough a transverse support member 7. An inner cover 8 is supported by and suspended from the support member 7. It of course will be understood that the support member 7 does not close the opening through the drivable member 6. Rather, support member 7 provides substantially no obstruction to the flow of coke through the opening through drivable member 6. Furthermore, the attachment of inner cover 8 to support member 7 is preferably of the rockable or swivel type. Thus, upon axial movement of drivable member 6 with respect to the charging port 2 and the neck 3, an upper sealing surface of inner cover 8 may be brought into tight sealing engagement with a surface 9 of the neck 3 of charging port 2 which generally faces away from the outer opening into the charging port 2. More particularly, axial movement of drivable member 6 outwardly of charging port 2 will bring the inner cover 8 into the sealing position shown in FIGS. 1 and 2. Similarly, axial movement of the drivable member 6 inwardly of the charging port 2 will cause inner cover 8 to be moved away from the sealing position, as shown in FIG. 3.

The upper portion of drivable member 6 may have sealingly mounted thereon either an outer cover, as shown in FIG. 1, or a coke container 19, as shown in FIG. 3. More particularly, the upper portion of drivable member 6 has an annular channel 10 having a closed bottom and an open top. The channel 10 has the interior thereof substantially filled with a yieldable sealing medium 11. Thus, channel 10 and yieldable sealing medium 11 form a seal forming arrangement for alternative cooperation with a downwardly extending annular flange or projection 16 of outer cover 15 or a substantially annular flange or projection 20 extending downwardly from coke supply container 19. Cooperation of annular projection 16 or of annular projection 20 with the yieldable sealing medium 11 in annular channel 10 will form an outer seal.

Figure 2:
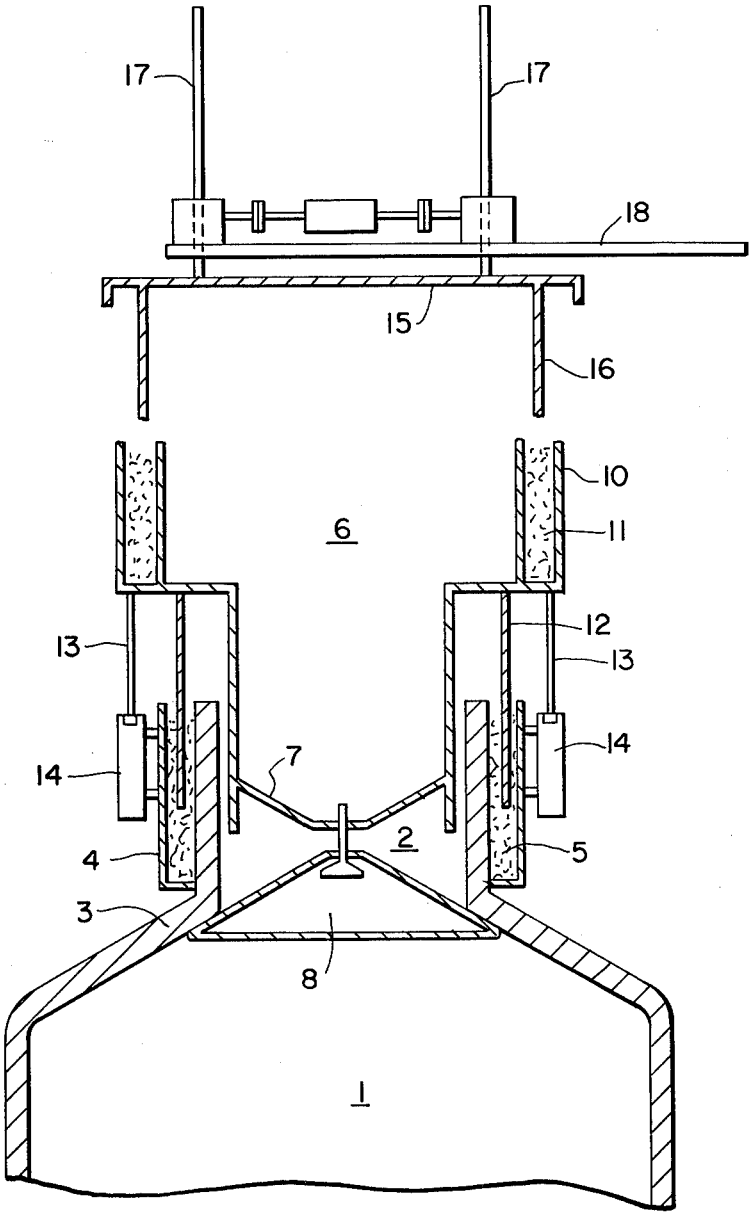
FIG. 2 is a schematic view similar to FIG. 1, but showing the outer cover in a raised, unsealed position, with the inner cover still being sealed.

Furthermore, the device according to the present invention includes means for providing a permanent intermediate seal between the structure of chamber 1 and the drivable member 6, either in the raised position of drivable member 6 as shown in FIGS. 1 and 2, or in the lowered position of drivable member 6 as shown in FIG. 3. More particularly, attached to an outer surface of the neck 3 of charging port 2 is an annular channel 4 having an open top and a closed bottom. Substantially filling the interior of the annular channel 4 is a yieldable sealing medium 5, which may be of the same material as yieldable sealing medium 11. Depending downwardly from the upper portion of drivable member 6 is an annular flange or projection 12 which extends into yieldable sealing material 5 by an amount sufficient to achieve a gastight seal during all relative positions of drivable member 6, and thus of projection 12. More particularly, the intermediate seal is gastight in the raised position of drivable member shown in FIGS. 1 and 2, as well as in the lowered position thereof as shown in FIG. 3.

Furthermore, in accordance with the present invention there is provided an arrangement for selectively moving the drivable member between the raised position thereof shown in FIGS. 1 and 2 and the lowered position thereof shown in FIG. 3. Such moving arrangement, in the illustrated embodiment, includes piston-cylinder arrangements of the hydraulic, pneumatic or electrical type, including cylinders 14 attached to the exterior of annular channel 4 and piston rods 13 attached to the drivable member 6. Thus, it will be apparent from FIGS. 1 through 3 that when the piston rods 13 are actuated to the expanded conditions shown in FIGS. 1 and 2, drivable member 6 will be moved outwardly of charging port 2, and inner cover 8 will be brought into sealing contact with surface 9 to form an inner seal. Similarly, when piston rods 13 are retracted into cylinders 14, as shown in FIG. 3 of the drawings, drivable member 6 will be moved inwardly of charging port 2, and inner cover 8 will be moved away from surface 9, thereby opening the inner seal and providing communication between the opening through the drivable member 6 and the interior of chamber 1.

The operation of the above device will now be described, to achieve a recharging of the chamber 1. More particularly, assume that chamber 1 is to receive a new charge of coke and that the inner cover 8 and outer cover 15 are in the positions shown in FIG. 1 of the drawings, wherein there are formed both an inner seal and an outer seal.

Then, outer cover 15 is removed from the drivable member 6 by means of lifting rods 17, which may be actuated in any known manner, and the outer cover 15 is driven along rails 18 to a position away from the top of drivable member 6. During this time of removal of the outer seal, the drivable member 6 is maintained (and may be locked, e.g. by horizontally slidable lockbolt 26 shown schematically in FIG. 1) in its upper position, as shown in FIG. 2, to thereby maintain the inner seal. Additionally, the intermediate seal is continuously maintained.

Thereafter, coke container 19 is mounted on the upper portion of drivable member 6, such that projection 20 extends into the yieldable sealing medium 11 within channel 10. There is thereby formed a new gastight outer seal. The piston-cylinder devices are then operated to retract piston rods 13 into cylinders 14, whereby drivable member 6 and coke container 19 are lowered into the position shown in FIG. 3. This lowers inner cover 8 and opens the inner seal. At this time the outer seal between coke container 19 and the drivable member 6 is maintained, and additionally the intermediate seal is maintained. Opening 19*a* in coke container 19 may then be activated to supply a new charge of coke from coke supply container 19 through the opening in drivable member 6 and into the chamber 1.

Thereafter, drivable member 6 is returned to its raised position, thereby again forming the inner seal, coke supply container 19 is removed from the drivable member 6, and then the outer cover 15 is returned to the closed position shown in FIG. 1, at which time all of the outer seal, the intermediate seal and the inner seal are closed in a gastight manner, and normal operation of the chamber 1 is initiated.

With reference now to FIG. 4 of the drawings a modification of the arrangement of the present invention will be shown. In this modification, a replaceable annular insert 21 is attached to the neck 3*a* of the charging port 2 and extends into the charging port 2. More particularly, replaceable annular insert 21 is attached to the neck 3*a* by means of clamps 22 and bolt-nut units 23. In this arrangement, the diameter or transverse size of inner cover 8 is less than the inner diameter of neck 3*a*, and when the inner cover 8 is in the sealing position to form the inner seal, inner cover 8 abuts against a lower surface 9*a* of the replaceable annular insert 21. By this arrangement, removal of the inner cover from the interior of the chamber is facilitated. That is, by simple removal of the replaceable annular insert 21, then inner cover 8 may be readily removed through the charging port 2.

Furthermore, in accordance with this modification of the present invention, replaceable annular insert 21 has a hollow interior 24, and there is provided a piping system 25 for supplying a cooling medium, for example a cooling liquid, through the hollow interior 24 of replaceable annular insert 21, thereby providing for cooling of the surface 9*a*.

It is to be understood that the yieldable sealing mediums 5 and 11 may be of any material which is capable of forming a satisfactory seal for the particular chamber construction involved and which is compatible with the particular materials involved. For example, mediums 5 and 11 may be formed of a granular or pulverulent material which is sufficiently resilient to receive the annular projections 12 and 16 or 20 and which will form a sufficiently airtight and/or dust-tight seal, for the given chamber structure and process involved.

Furthermore, it will be apparent from the above discussion that during normal operation of the chamber there will be formed three seals, and that even during the charging or supplying of the chamber 1 there will always be at least two seals. Thus, the pollution and safety hazard disadvantages of prior art arrangements are overcome.

Although the process and apparatus of the present invention have been described above and have been illustrated with respect to specific preferred operations and structural arrangements, it is to be understood that the scope of the present invention is not intended to be limited thereby and that various modifications to such operations and arrangements may be made without departing from the scope of the present invention.

What is claimed is:

1. An arrangement for closing a charging port of a chamber, particularly of a cooling chamber for dry coke cooling, said arrangement comprising:

a drivable member adapted to be movably mounted adjacent a chamber charging port to be closed;

an outer cover movable between a closed position in sealing engagement with said drivable member and sealingly closing the top thereof and an open position away from said drivable member;

an inner cover supported by said drivable member and movable thereby between a sealing position whereat said inner cover is adapted to seal against a surface of the chamber charging port which faces generally away from said outer cover and an open position spaced from such surface; and a material supply container movable into position in sealing contact with said drivable member and sealingly closing the top thereof when said outer cover is in said open position away from said drivable member.

2. An arrangement as claimed in claim 1, wherein said drivable member includes a lower portion adapted to be inserted into the chamber charging port and an upper portion adapted to be positioned outwardly of the chamber charging port, and said drivable member has extending therethrough an opening adapted to communicate with the chamber.

3. An arrangement as claimed in claim 2, further comprising a support member extending transversely across said opening in said lower portion of said drivable member, said inner cover being rockably suspended from said support member at a position below said lower portion of said drivable member.

4. An arrangement as claimed in claim 2, wherein said upper portion of said drivable member includes means for forming an outer seal.

5. An arrangement as claimed in claim 4, wherein said outer seal forming means comprises a channel surrounding said opening and having a closed bottom and an open top, said channel having therein a yieldable sealing medium.

6. An arrangement as claimed in claim 5, wherein said outer cover has depending therefrom a substantially annular projection dimensioned to extend into said yieldable sealing medium within said channel when said outer cover is in said closed position thereof.

7. An arrangement as claimed in claim 5, further comprising means for lifting said outer cover away from sealing engagement with said drivable member, said material supply container having depending therefrom a substantially annular projection dimensioned to extend into said yieldable sealing medium within said channel, and to thereby form a seal between said material supply container and said drivable member.

8. An arrangement as claimed in claim 4, further comprising means adapted to be fixed to the exterior of the chamber for forming an intermediate seal with said drivable member.

9. An arrangement as claimed in claim 8, wherein said intermediate seal forming means comprises a channel adapted to surround the charging port of the chamber and having a closed bottom and an open top, said channel having therein a yieldable sealing medium.

10. An arrangement as claimed in claim 9, wherein said upper portion of said drivable member has depending therefrom a substantially annular projection dimensioned to extend into said yieldable sealing medium within said channel.

11. An arrangement as claimed in claim 2, further comprising means adapted to be fixed to the exterior of the chamber for forming an intermediate seal with said drivable member.

12. An arrangement as claimed in claim 11, wherein said intermediate seal forming means comprises a channel adapted to surround the charging port of the chamber and having a closed bottom and an open top, said channel having therein a yieldable sealing medium.

13. An arrangement as claimed in claim 12, wherein said upper portion of said drivable member has depending therefrom a substantially annular projection dimensioned to extend into said yieldable sealing medium within said channel.

14. An arrangement as claimed in claim 2, further comprising means fixed to said drivable member and adapted to be fixed to the exterior of said chamber for moving said drivable member axially of the charging port between a raised position whereat said inner cover is in said sealing position thereof and a lowered position whereat said inner cover is in said open position thereof.

15. An arrangement as claimed in claim 14, wherein when said outer cover is in said closed position thereof, said moving means is operable to lock said drivable member in said raised position thereof.

16. An arrangement as claimed in claim 14, further comprising means for lifting said outer cover away from sealing engagement with said drivable member and for replacing said outer cover with said material supply container to supply material into the chamber, whereafter said drivable member may be moved to said lower position thereof by said moving means.

17. An arrangement as claimed in claim 14, further comprising a channel adapted to be fixed to the exterior of the chamber, said moving means being fixed to the exterior of said channel, said channel adapted to surround the charging port of the chamber and having a closed bottom and an open top, said channel having therein a yieldable sealing medium, and said upper portion of said drivable member has depending therefrom a substantially annular projection dimensioned to extend into said yieldable sealing medium within said channel.

18. An arrangement as claimed in claim 17, wherein said annular projection has a lower end which extends into said yieldable sealing medium by a distance to form a seal in both said raised position and said lowered position of said drivable member.

19. An arrangement as claimed in claim 1, further comprising a replaceable annular insert adapted to be positioned within the charging port of the chamber, said insert including said surface, said inner cover having a transverse dimension less than that of the charging port, whereby said inner cover is readily removable from the chamber.

20. An arrangement as claimed in claim 19, wherein said insert has a hollow interior, and further comprising means for introducing a cooling medium into said hollow interior.

21. A process for charging and sealing a charging port of a chamber, particularly of a cooling chamber for dry coke cooling, said process comprising the steps of:

(a) providing a drivable member having an opening therethrough, a lower portion, an upper portion, and an inner cover suspended from said lower portion;

(b) mounting said drivable member on a chamber by inserting said lower portion into a charging port of said chamber, with said inner cover being positioned within said chamber and said upper portion positioned outwardly of said charging port;

(c) forming an intermediate seal between the exterior of said charging port and said drivable member;

(d) selectively moving said drivable member axially of said charging port between a raised position, whereat said inner cover is moved into a sealing position sealed against an inner surface of said charging port of said chamber to form an inner seal, and a lowered position, whereat said inner cover is moved away from said inner surface into an open position opening said inner seal;

(e) maintaining said intermediate seal during movement of said drivable member to both said raised and lowered positions thereof;

(f) while said drivable member is in said raised position thereof, selectively positioning a material supply container on said upper portion of said drivable member and forming an outer seal therebetween;

(g) thereafter, moving said drivable member to said lowered position thereof, and discharging material from said container through said opening and said charging port into said chamber, thereby charging said chamber;

(h) thereafter, returning said drivable member to said raised position thereof, removing said container from said upper portion of said drivable member, and positioning an outer cover on said upper portion of said drivable member and forming an outer seal therebetween; and (i) thereafter, when it is desired to supply a new charge of material into said chamber, removing said outer cover from said upper portion of said drivable member, and repeating said above-mentioned operations of steps (f), (g) and (h), whereby said intermediate seal is maintained at all times, and whereby at least one of said inner seal and said outer seal is maintained at all times.

22. A process as claimed in claim 21, further comprising locking said drivable member in said raised position thereof.

23. A process as claimed in claim 21, further comprising positioning a replaceable annular insert within said charging port, said inner surface against which said inner cover seals comprising a surface of said insert.

24. A process as claimed in claim 23, wherein said insert has a hollow interior, and further comprising introducing a cooling medium into said hollow interior.

* * * * *